US007121648B2

(12) United States Patent
Iida et al.

(10) Patent No.: US 7,121,648 B2
(45) Date of Patent: Oct. 17, 2006

(54) DROPLET EJECTION METHOD AND DEVICE

(75) Inventors: Yoshihiro Iida, 1772-4, Koshigoe, Kamakura-shi, Kanagawa (JP); Kunito Okuyama, 1-606, Tomiokahigashi 2-8, Kanazawa-ku, Yokohama-shi, Kanagawa (JP); Naoki Morita, Ebina (JP)

(73) Assignees: Fuji Xerox Co., Ltd., Tokyo (JP); Yoshihiro Iida, Kamakura (JP); Kunito Okuyama, Yokohama (JP)

( * ) Notice: Subject to any disclaimer, the term of this patent is extended or adjusted under 35 U.S.C. 154(b) by 245 days.

(21) Appl. No.: 10/852,454

(22) Filed: May 25, 2004

(65) Prior Publication Data

US 2005/0007423 A1 Jan. 13, 2005

(30) Foreign Application Priority Data

May 26, 2003 (JP) ..... 2003-147874

(51) Int. Cl.
*B41J 2/05* (2006.01)
*B41J 29/38* (2006.01)

(52) U.S. Cl. ..... 347/60; 347/11

(58) Field of Classification Search ..... 347/10, 347/11, 17, 54, 56, 60, 61
See application file for complete search history.

(56) References Cited

U.S. PATENT DOCUMENTS 6,139,125 A * 10/2000 Otsuka et al. ..... 347/11
6,231,167 B1 * 5/2001 Tsuboi et al. ..... 347/65

FOREIGN PATENT DOCUMENTS

| | | |
|---|---|---|
| JP | 54-39470 | 3/1979 |
| JP | A 63-132059 | 6/1988 |
| JP | A 2-214664 | 8/1990 |
| JP | A 9-21909 | 1/1997 |
| JP | A 2000-97894 | 4/2000 |
| JP | A 2000-246887 | 9/2000 |
| JP | A 2000-246899 | 9/2000 |
| JP | A 2001-228162 | 8/2001 |
| JP | A 2001-232245 | 8/2001 |
| JP | A 2001-301154 | 10/2001 |
| JP | A 2002-205370 | 7/2002 |
| JP | A 2002-273869 | 9/2002 |
| JP | A 2003-53747 | 2/2003 |
| JP | A 2003-90904 | 3/2003 |

* cited by examiner

*Primary Examiner*—An H. Do
(74) *Attorney, Agent, or Firm*—Oliff & Berridge, PLC

(57) ABSTRACT

A droplet-jetting device having high jetting ability, which includes an actuator featuring a liquid chamber and a heater and a controller. The liquid chamber has an aperture for jetting droplets of an operation liquid which the liquid chamber accommodates. The heater provides thermal energy to the operation liquid and forms bubbles for droplet-jetting. The controller controls a driving signal, which is inputted to the heater. The driving signal includes a preparatory heating pulse signal, which corresponds to a preparatory heating energy for preparatory heating of the operation liquid, and a trigger pulse signal, which corresponds to a jetting thermal energy for bubble creation and growth. A power supplied by the preparatory heating pulse signal is smaller than a power supplied by the trigger pulse signal, and a heating duration by the preparatory heating pulse signal is longer than a heating duration by the trigger pulse signal.

20 Claims, 19 Drawing Sheets

Abmax (MAXIMUM BUBBLE AREA)

Ah (HEATER AREA)

DROPLET EJECTION METHOD AND DEVICE

CROSS-REFERENCE TO RELATED APPLICATION

This application claims priority under 35USC 119 from Japanese Patent Application No. 2003-147874, the disclosure of which is incorporated by reference herein.

BACKGROUND OF THE INVENTION

1. Field of the Invention

The present invention relates to a droplet ejection method and device, and more specifically relates to a droplet ejection method and device for ejecting droplets by the application of thermal energy.

2. Description of the Related Art

Microactuators are known which, by using thermal energy or the like to cause a liquid to fly onto a medium in the form of small particles (known as droplets), form images of patterns and the like or form bodily structures of the liquid. Inkjet printer head technology is widely known as a technology which utilizes one of the functions of these microactuators. That is, in a printer which utilizes inkjet technology, ink droplets are jetted to provide an image on a paper surface.

Microactuators eject some kind of functional liquid onto a medium, implement patterning, and thus provide functionality to the medium.

Microactuators that are known include, for example, microactuators which are used for fabricating color filters, microactuators which are used for fabricating microlenses, microactuators which are used in medical nanopipettes, microactuators which are used for fabricating sensors, microactuators which are used for producing plates, proof plates and the like, and the like.

As applications for microactuators in color filter fabrication technology, a technique relating to a method of arrangement when filter material is to be discharged (see Japanese Patent Application Laid-pen (JP-A) No. 2002-273869) and a technique of controlling thickness and volume when a color filter is to be fabricated (see JP-A No. 9-21909) have been proposed. Further, for cases of applying microactuators to the fabrication of microlenses, a technique of focusing ultrasonic waves on a liquid surface in order to dropletize a curable resin liquid (see JP-A No. 2003-90904), and a structure of a lens fabrication apparatus together with a technique for ejecting variable weight amounts of a lens material liquid (see JP-A No. 2003-53747) have been proposed.

Further still, the application of microactuators to inkjets which serve as pipettes, which are mainly for medical use, has been investigated (see JP-A numbers 2001-228162 and 2001-232245). For the application of microactuators to the fabrication of sensors, a technique of discharging organic material onto electrodes by inkjets to form thin-film sensors has been proposed (see JP-A No. 2000-97894 and the publication of JP-A No. 2000-97894). For the application of microactuators to the production of plates, proof plates and the like, a method of controlling a recording head when fabricating a planographic plate with an inkjet has been proposed (see JP-A No. 2002-205370). Further yet, as microactuators which utilize electric fields, technologies which utilize electric fields for methods of more stably applying functional liquids to media have been investigated (see JP-A Nos. 2001-301154 and 2000-246887).

Variability of discharge amounts, breadth of a range of such variability, larger ejection forces, and the ability to eject various kinds of functional liquid are sought after as characteristics of these microactuators. Piezo-type actuators which are dependent on electromechanical transduction operations, actuators which utilize electric fields, and thermal boiling-type (thermal inkjet (TU)) actuators which utilize rapid heating and boiling are available as actuators that realize these characteristics.

Thermal boiling-type microactuators, in which displacement amounts that are achievable per unit area are large, are preferable for achieving reductions in size, cost and the like of microactuators. For pulse systems which utilize usual inkjets, in which these thermal boiling-type microactuators are applicable, technologies in which a pre-heating bias is applied before rising of a discharge pulse, a signal is applied for preliminary heating without forming bubbles, and a volume of ejected droplets is altered by the pre-heating, and/or in which a heater-driving waveform is varied from a simple rectangular wave have been proposed (see JP-A Nos. 63-132059, 54-39470, 2-214664 and 2000-246899). However, with pulse signals which are heater-driving signals for ejecting ink that is used in inkjets, in a case in which a single heater-driving waveform is simply altered and used at a microactuator, as heretofore, an ejection force for jetting of a functional liquid is inadequate. In other words, conventional techniques provide stable ejection states, but do not consider ejection forces.

In order to achieve a large ejection force with a thermal boiling-type microactuator, it is necessary to control behaviors relating to the generation of bubbles, which is based on rapid heating and boiling due to the application of thermal energy. Therefore, it is necessary to consider such behaviors and provide thermal energy to provide such behaviors.

SUMMARY OF THE INVENTION

The present invention will provide a droplet ejection method and device capable of ejecting a functional liquid simply and with large ejection power, i.e., pressure impulse ($Ns/m^2$) which is realized by maintaining bubble growth.

According to a first aspect of the present invention, a droplet ejection device with high ejection capability is provided, the device including: (a) an actuator including a fluid chamber with an aperture for ejecting a droplet of an operation fluid accommodated in the fluid chamber, and a heater for providing thermal energy to the operation fluid for forming a bubble for droplet ejection; and (b) a controller which controls a driving signal to be inputted to the heater, (c) wherein the driving signal includes a preliminary heating pulse signal, which corresponds to a preliminary heating energy for preliminary heating of the operation fluid, and a trigger pulse signal, which corresponds to an ejection thermal energy for generation and growth of the bubble, a supply power of the preliminary heating pulse signal is smaller than a supply power of the trigger pulse signal, and a duration of heating by the preliminary heating pulse signal is longer than a duration of heating by the trigger pulse signal.

According to another aspect of the present invention, a method for ejecting a droplet by inputting a driving signal to a heater for providing thermal energy to an operation fluid and forming a bubble for droplet ejection is provided, the method including the steps of: inputting to a heater a preliminary heating pulse signal, which corresponds to a preliminary heating energy for preliminary heating of the operation fluid, with a predetermined supply power and a predetermined heating duration, for accumulating the preliminary heating energy in the operation fluid; and inputting to the heater a trigger pulse signal, which corresponds to an ejection thermal energy for generation and growth of the bubble, with a pre-established supply power and a preestablished heating duration, for providing the ejection thermal energy to the operation fluid and generating and growing the bubble, wherein the supply power of the preliminary heating pulse signal is smaller than the supply power of the trigger pulse signal, and the heating duration by the preliminary heating pulse signal is longer than the heating duration by the trigger pulse signal.

BRIEF DESCRIPTION OF THE DRAWINGS

Preferred embodiments of the present invention will be described in detail based on the following figures, wherein.

DETAILED DESCRIPTION OF THE INVENTION

Now, an embodiment of the present invention will be described in detail with reference to the drawings.

Figure 1:
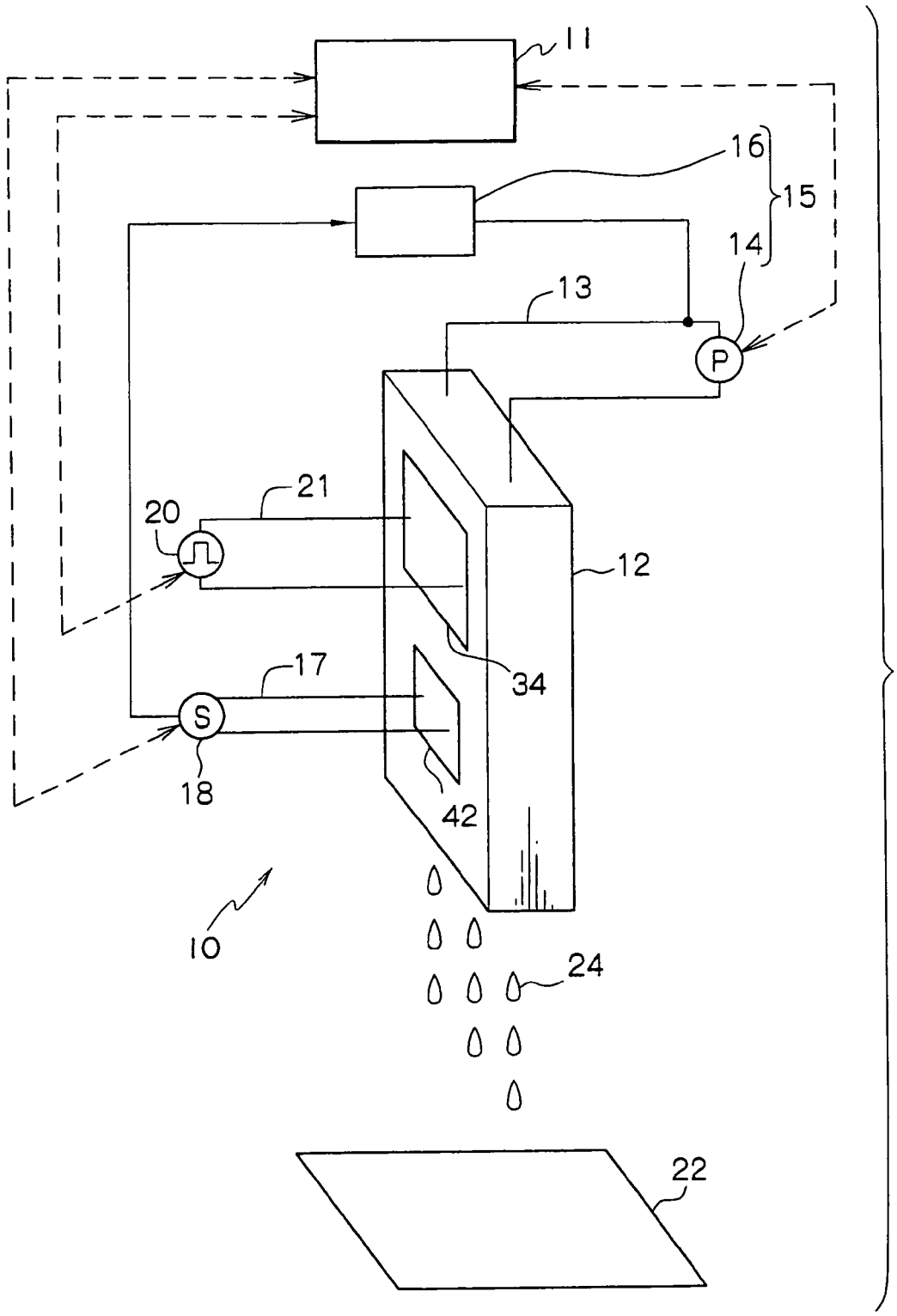
FIG. 1 is a block diagram showing general structure of a droplet ejection device relating to an embodiment of the present invention.

FIG. 1 shows general structure of a droplet ejection device 10 relating to the embodiment of the present invention. The droplet ejection device 10 is equipped with an actuator 12, which is a mechanical portion which ejects droplets. The actuator 12 is connected to a circulation section 15, a driving section 20 and a sensor output detection section 18. The circulation section 15 causes an operation fluid, which is to be ejected in the form of droplets, to circulate in the actuator 12. The driving section 20 feeds driving signals for heating a heater, which is provided in the actuator 12. The sensor output detection section 18 is for detecting output signals of sensors which are provided in the actuator 12.

The circulation section 15 is equipped with a pump 14 and a liquid regulation mechanism section 16. The pump 14 and the liquid regulation mechanism section 16 communicate through circulation piping 13. Further, the sensor output detection section 18 is connected to the actuator 12 by sensor signal wiring 17, and the driving section 20 is connected to the actuator 12 by driving signal wiring 21.

The droplet ejection device 10 is provided with a computer 11, which controls the sensor output detection section 18, the pump 14, the liquid regulation mechanism section 16 and the driving section 20 all together. The computer 11 controls ejection data for ejecting the droplets.

At the actuator 12, portions of the operation fluid are jetted in the form of droplets 24, by driving of the heater which is provided in the actuator 12, and reaches a medium 22. The actuator 12 is mounted at a transport system, and is rendered relatively movable in one dimension or in two or more dimensions relative to the medium 22. Because the actuator 12 is a structure which can move freely within a space, the operation fluid can be jetted to arbitrary positions.

Figure 2:
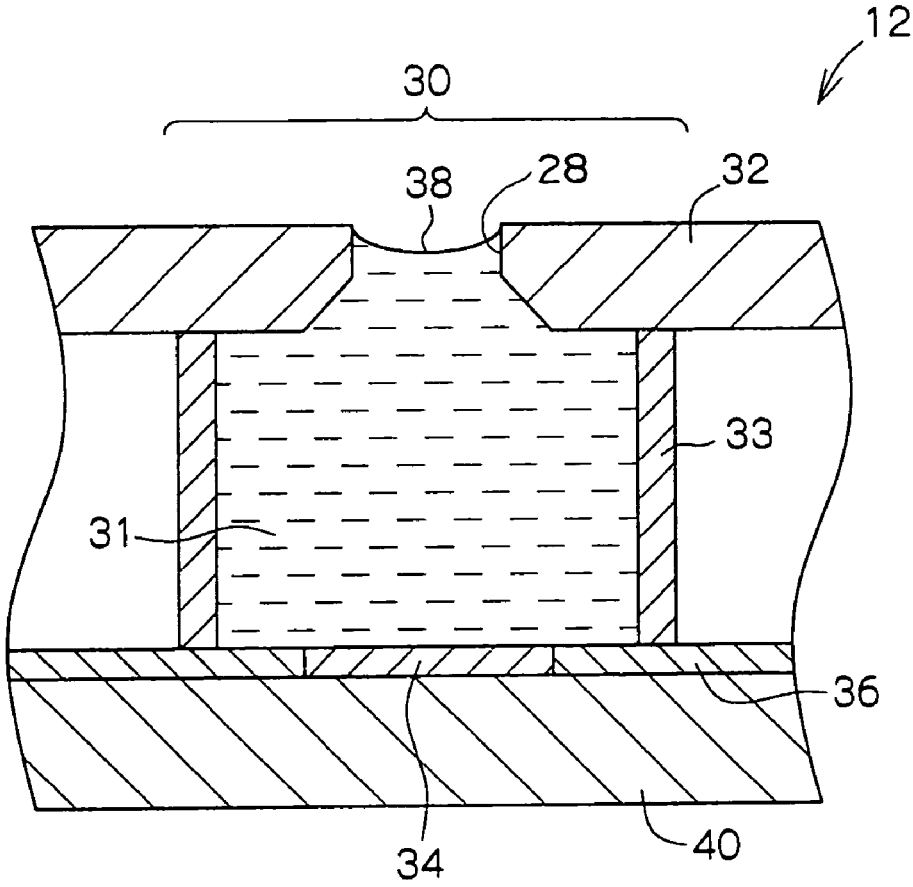
FIG. 2 is a sectional view showing structure of an actuator relating to the present embodiment.

FIG. 2 shows details of a unit structural portion 30, which structures the actuator 12 and ejects individual droplets. The unit structural portion 30 of the actuator 12 is equipped with a heater 34, which is provided on a baseplate 40. The heater 34 is equipped with an electrode 36. A nozzle 32 including an aperture 28 is provided at a position which is separated from the heater 34. Sides of the nozzle 32 side and the baseplate 40 including the heater 34 are connected by bridging portions 33. A liquid chamber 31, which accommodates operation liquid 38, is structured by sides of the nozzle 32, the bridging portions 33 and the baseplate 40. The liquid chamber 31 communicates with the circulation piping 13. Thus, circulation of the operation liquid 38 in the liquid chamber 31 is enabled.

The nozzle 32 side of the unit structural portion 30 described above serves as a side for ejection of the droplets 24. When a plurality of the unit structural portion 30 are arranged in a row or in two dimensions, it is possible to eject pluralities of droplets.

Here, in order to structure the actuator 12 for a high ejection efficiency which enables the provision of large bubbles for discharge of the operation liquid 38, it is preferable for sufficient capacity of the liquid chamber 31 to be assured.

Figure 3:
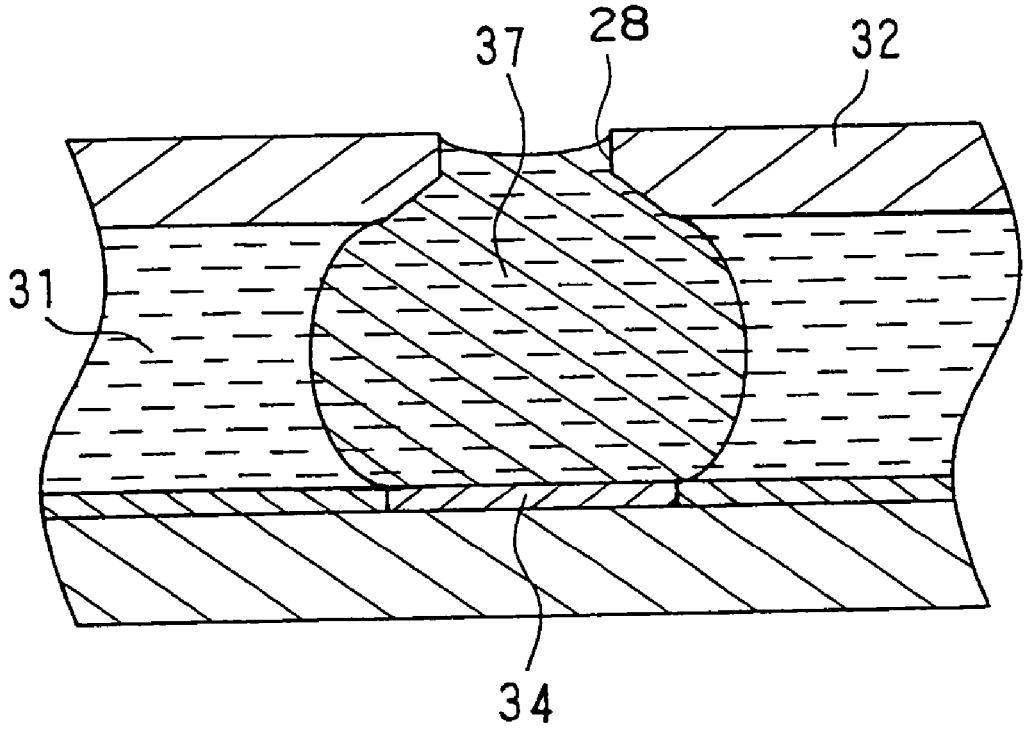
FIG. 3 is another sectional view showing structure of the actuator relating to the present embodiment.

For example, as shown in FIG. 3, in a case in which the liquid chamber 31 side faces of the heater 34 and nozzle 32 are close together, the area of an ejectable portion 37 will be very small. In such a case, it may be difficult to generate large bubbles. Therefore, with regard to design of the liquid chamber 31, it is preferable to ensure a volume thereof of approximately twice the volume of a bubble at which a heater area is the lower face of a hemisphere, and at least the volume of a sphere of which the heater area is a diametric plane. Accordingly, a high-efficiency actuator can be provided. Note that, while nozzle diameter is also an important parameter, it is necessary to take into account ejection speed of the liquid and viscosity of the liquid in the design, and the nozzle diameter can be determined within an optimum range.

Figure 4:
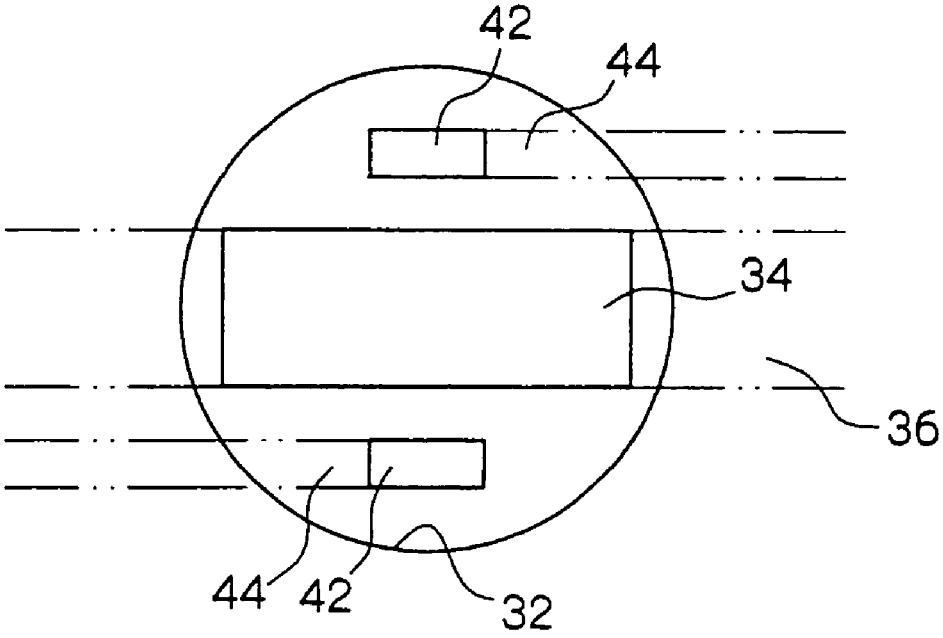
FIG. 4 is a plan view showing structure of the actuator relating to the present embodiment.

FIG. 4 is a plan view of general structure of the unit structural portion 30 as seen from the nozzle 32 side thereof. Sensors 42 are disposed at both sides of the heater 34. The sensors 42 are detectors for detecting a property of the operation liquid 38 that represents a condition of the operation liquid 38 in the liquid chamber 31. In the present embodiment, an example is employed in which a physical value of the operation fluid is measurable in a vicinity of the heater, and a current flow between the sensors 42 is measured by the sensors 42.

The operation liquid 38 is considered to have a consistent physical value when the current value at the sensors 42 is a predetermined value or is within a predetermined range or the like. Current values at the sensors 42 are inputted into the sensor output detection section 18. The sensor output detection section 18 outputs regulation signals to the liquid regulation mechanism section 16 in order to keep properties of the operation liquid 38 constant according to the inputted current values. The liquid regulation mechanism section 16 regulates composition of the operation liquid 38 in accordance with the regulation signals that are inputted thereat. Thus, the physical value of the operation fluid is kept constant; that is, the properties of the operation liquid 38 can be kept constant.

For the present embodiment, a case in which ethanol is used as the operation liquid 38 will be described. However, the present invention is not limited to this. That is, operation fluids can be selected in accordance with respective goals. As will be described later, in accordance with physical characteristics of an operation fluid, it is possible to structure and control the actuator with consideration of a starting temperature of rapid heating and boiling, of electrical power that is inputted for implementing the rapid heating and boiling and of a heating rate thereof, of excess heat energy that is accumulated in layers of the fluid, and the like.

Additionally, the heater can provide thermal energy to the operation fluid at least one of directly and via a heater protection layer.

Figure 5:
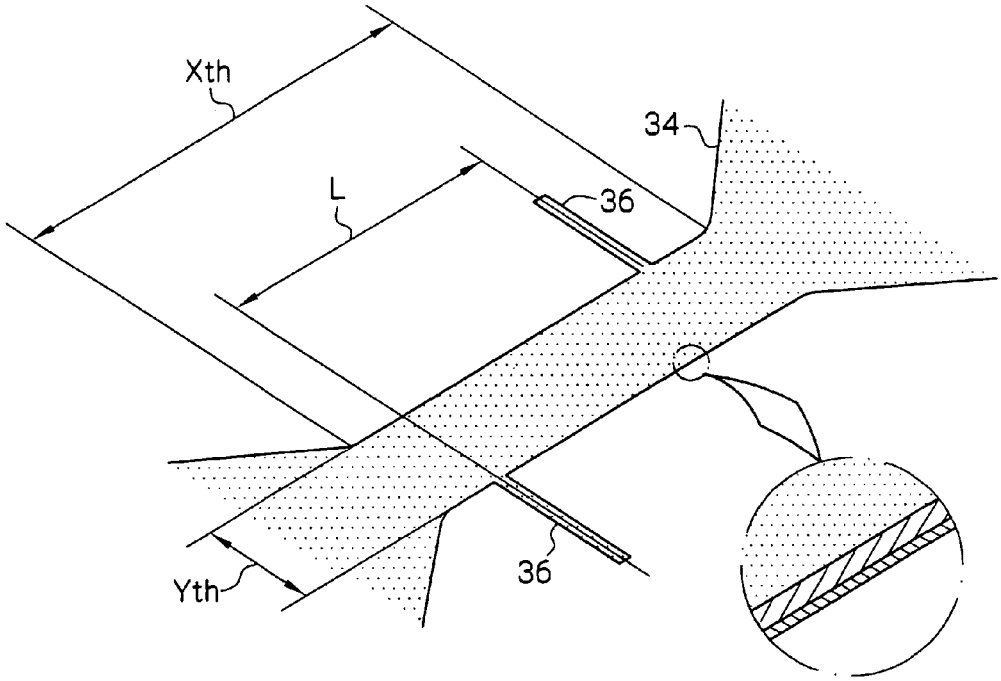
FIG. 5 is a perspective view showing structure of a heater relating to the present embodiment.

FIG. 5 shows an example of the heater 34 which is applicable to the actuator 12 of the present embodiment. The heater 34 is a structure including a rectangular region which is effective for heating (with length Xth and width Yth), and is provided with the electrodes 36 for feeding the driving signals to a central portion of the heater 34. In consideration of heating efficiency, the electrodes 34 are provided as leader lines (or traces) with a predetermined width L (for example, 0.01 mm) and are separated by a predetermined spacing (for example, 0.25 mm).

In the present embodiment, as the rectangular area that is effective for heating, a rectangular heater fabricated of platinum with an illustrated effective heating length of 400 μm and heating width of 100 μm is employed to serve as the heater 34. This platinum rectangular heater is formed by vapor-depositing titanium and platinum on a quartz glass surface so as to form a sequence of layers with predetermined thicknesses (Ti: 0.05 μm and Pt: 0.20 μm).

Now, although platinum, which is resistant to corrosion, is used as the heater material for the present embodiment, Ta, TaN and the like are available as metallic materials to be applied to other heaters. Furthermore, it is possible to utilize materials which are applied to transistor processes, such as PolySi and the like.

Next, a process of creating bubbles, by heating the operation liquid 38 with the heater 34, and ejecting the droplets 24 in the present embodiment will be described with reference to FIGS. 6A to 6E.

Figures 6A, 6B, 6C, 6D, 6E:
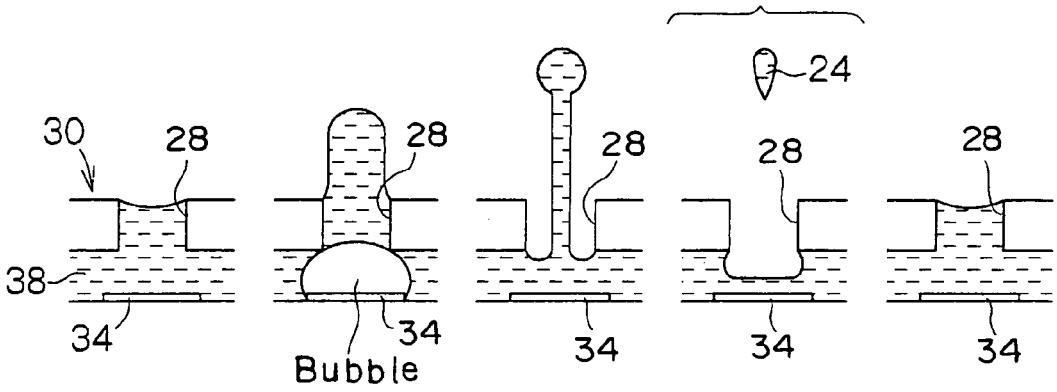
FIGS. 6A to 6E are explanatory views for explaining a process of ejecting a droplet.

Before operation, the operation liquid 38 is accommodated in the liquid chamber 31 of the unit structural portion 30 (see FIG. 6A). A bubble is generated in the operation liquid 38 in the liquid chamber 31 by the heater 34 heating the operation liquid 38. The bubble grows rapidly and the operation liquid 38 moves beyond the aperture 28 of the nozzle 32 in accordance with the expansion of the bubble (see FIG. 6B). Subsequently, when the bubble goes into diminution, a liquid column arises (see FIG. 6C). This liquid column separates from the operation liquid 38 in the liquid chamber 31 and is ejected in the form of the droplet 24 (see FIG. 6D). Thereafter, the operation liquid 38 is replenished in accordance with the amount of the operation liquid 38 that was ejected (see FIG. 6E). Thus, the droplet 24 is jetted from the actuator 12.

The present inventors have, by various investigations and experiments, obtained findings that: when a bubble is to be created by heating and a droplet is to be ejected, in order to attain an adequate droplet amount, it is preferable to provide adequate heat energy beforehand to a fluid layer which is in contact with the heater 34, which is to apply a heating amount (thermal energy); and, before the creation of the bubble has commenced in accordance with the rapid heating and boiling, it is preferable to apply heating at an interface of the operation liquid 38 with the heater 34 to an extent which does not cause the operation liquid 38 to bubble, that is, to apply sufficient pre-heating to the liquid boundary surface contacting the heater 34.

The application of heating, that is, a thermal energy which is capable of providing an adequate droplet amount when the droplet is to be ejected will be described.

FIGS. 7A to 7F are drawings showing, in plan view, states of progress of changes with time of a bubble that is generated as a result of a single pulse having electrical power being applied in order to heat the heater 34. FIGS. 8A to 8F are sectional views of FIGS. 7A to 7F.

Figure 7A:
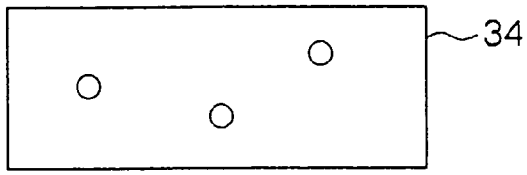
FIGS. 7A to 7F are explanatory views for explaining a process from creation to diminution of a bubble by heater heating.
Figure 7B:
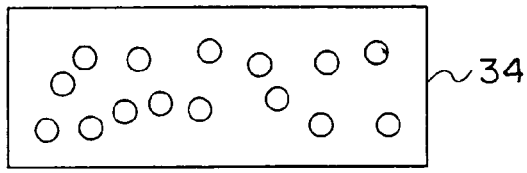
Figure 7C:
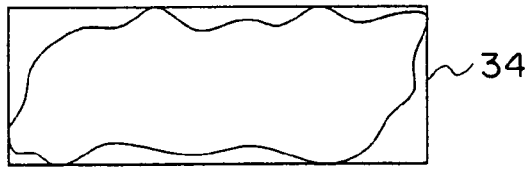
Figure 7D:
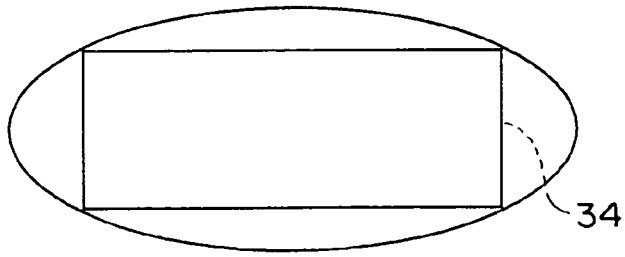
Figure 7E:
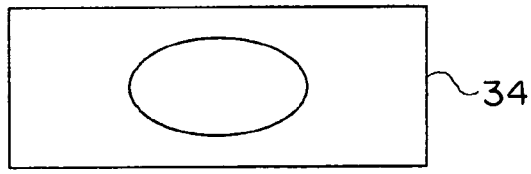
Figure 7F:
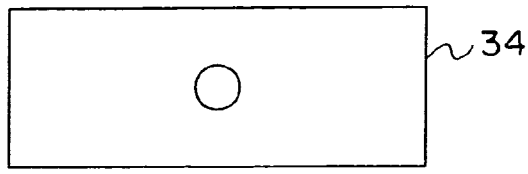
Figure 8A:
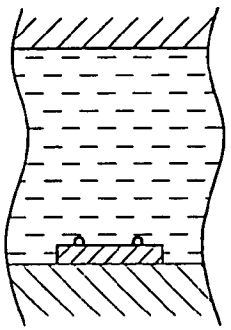
FIGS. 8A to 8F are sectional views of FIGS. 7A to 7F, respectively.
Figure 8B:
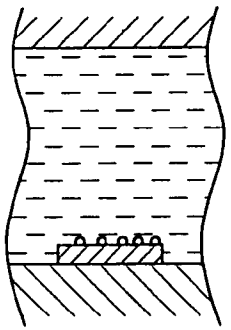
Figure 8C:
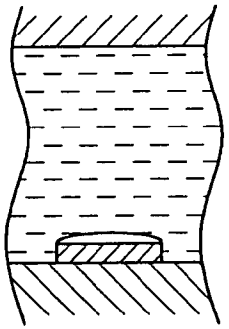
Figure 8D:
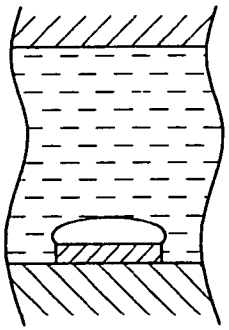
Figure 8E:
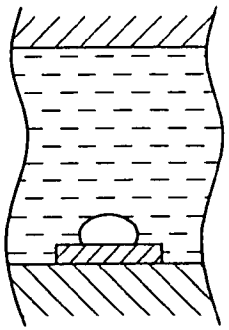
Figure 8F:
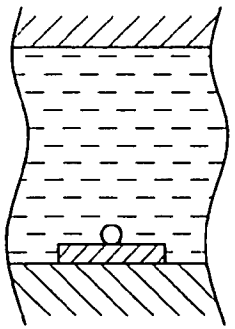

When the single pulse is applied to the heater 34, the heater 34 commences heat generation, and generates bubbles in accordance therewith (see FIG. 7A). Thus, bubbles are created scattered over a heat-generating surface of the heater 34 (see FIG. 7B). Subsequently, the numerous scattered bubbles combine (see FIG. 7C), and attain a maximum size (see FIG. 7D). Subsequently, this bubble proceeds to diminution (see FIGS. 7E and 7F).

Figure 9:
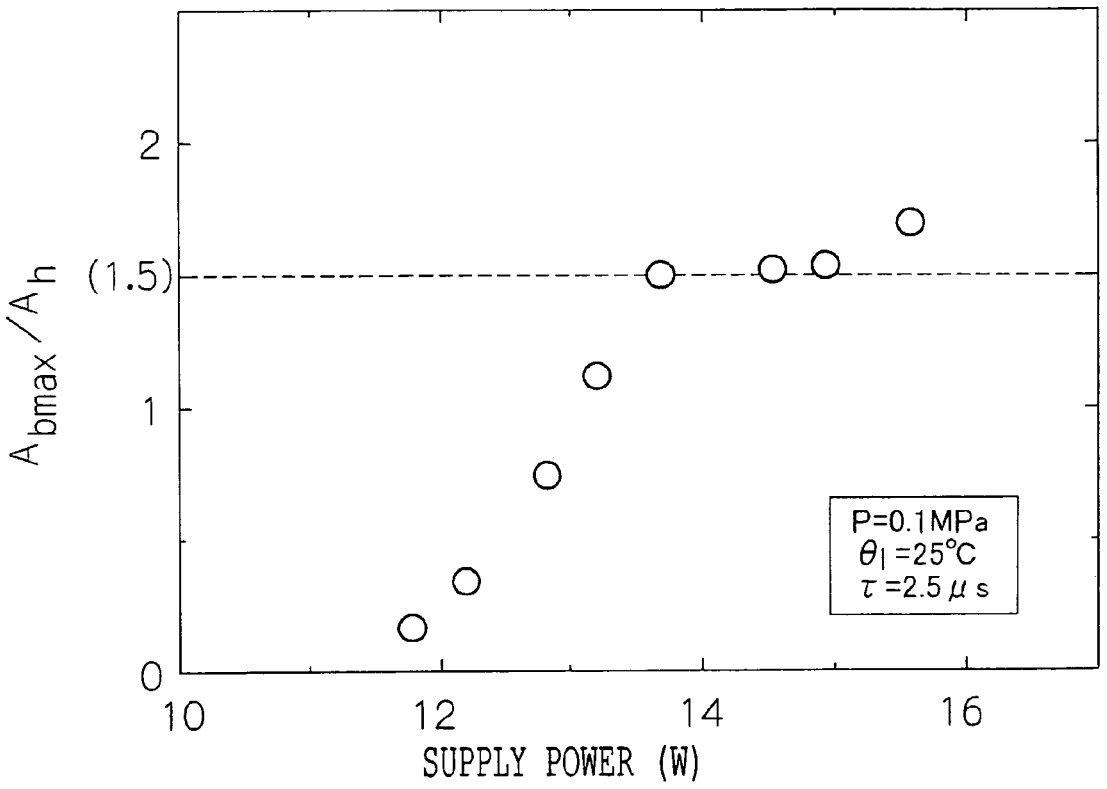
FIG. 9 is a characteristic showing a relationship between electrical power of a single pulse signal and area of a bubble.

FIG. 9 is a graph showing a relationship of maximum bubble area with respect to changes in supply power when single-pulse driving signals are applied to the heater 34 for heating. In this graph, the horizontal axis is electrical power (W), and the vertical axis is an area ratio (the bubble's maximum area Abmax/the heater's area Ah).

As shown in FIG. 9, it can be seen that as the supply power becomes higher, which is to say as a rate of heating (a rise in temperature per unit time (K/s)) becomes more rapid, the bubble area becomes larger, but then the bubble area maximizes at around 1.5 times area of the heater. Thus, the bubble area cannot increase further if the supply power is simply increased from approximately 14 W or thereabouts. The behavior of the bubbles shown in FIGS. 7A to 7F is represented in FIG. 9 by the region in which the bubble area is stable with respect to the supply power.

Figure 10:
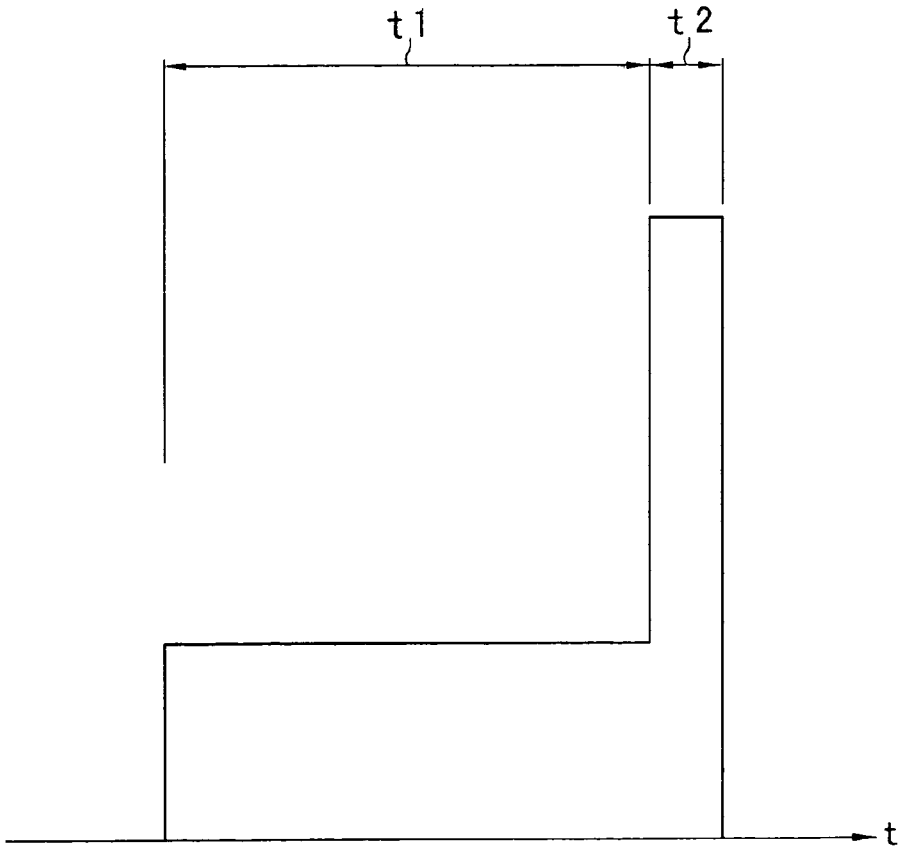
FIG. 10 is a waveform pattern view showing a relationship between a preliminary heating pulse signal and a trigger pulse signal.
Figure 11A:
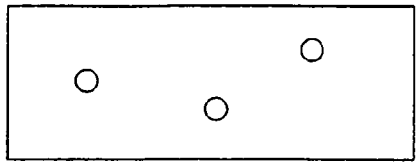
FIGS. 11A to 11E are image views showing behavior of a bubble which is generated by the preliminary heating pulse signal and the trigger pulse signal.
Figure 11B:
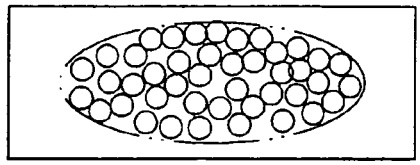
Figure 11C:
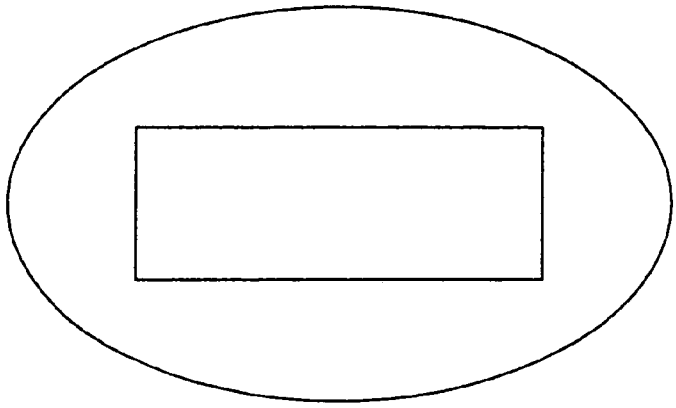

The present inventors have, through various investigations, found that an extremely large bubble as shown in FIG. 11C is generated in a case in which, rather than supplying a single pulse to the heater 34, heating of the heater is implemented by a pulse of two steps, referred to as a preliminary heating pulse and a trigger pulse, as shown in FIG. 10.

Figure 11D:
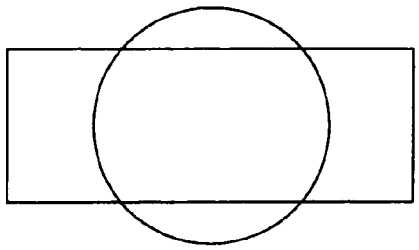
Figure 11E:
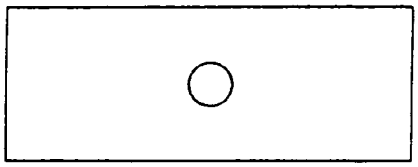

A driving signal provided to the heater 34 is constituted by a preliminary heating pulse signal of duration t1 and a trigger pulse signal of duration t2 (FIG. 10). The behavior of the bubbles at the actuator 12 when this driving signal is provided is as follows. When the two-step pulse is applied to the heater 34, the heater 34 starts to generate heat, and bubbles are generated in accordance therewith (see FIG. 11A). Hence, the bubbles are generated scattered at a central vicinity of the heating surface of the heater 34 (see FIG. 11B). Subsequently, the numerous scattered bubbles proceed to combine, and attain maximum size (see FIG. 11C). Thereafter, the bubble proceeds to diminution (see FIGS. 11D and 11E).

Accordingly, the results of detailed investigations of two-step pulse waveforms for obtaining larger bubbles are illustrated herebelow.

<Investigation 1>

Figure 12:
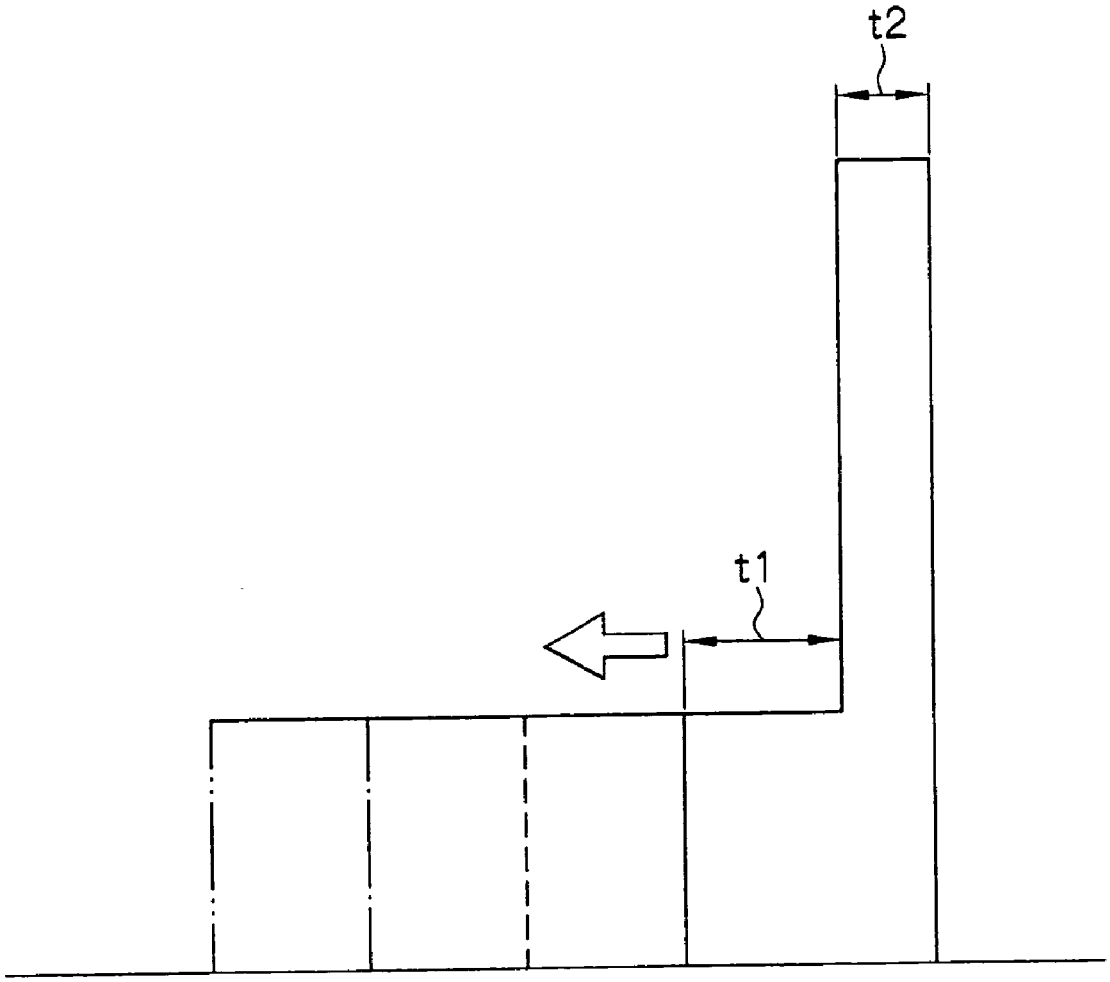
FIG. 12 is a waveform pattern view showing a relationship between the preliminary heating pulse signal and the trigger pulse signal.

In a first investigation, maximum bubble sizes were measured and studied for cases in which the duration t2 of the trigger pulse signal was set to a constant (1 μs) and the duration t1 of the preliminary trigger pulse signal was variably set, as shown in FIG. 12. The variable duration was increased by 10 μs increments from 10 to 60 μs for the measurements.

The power of the trigger pulse signal was set to 6.0 W and the power of the preliminary heating pulse signal was set to 1.5 W. Although this power ratio was set to 1/4, the present invention is not limited thus. However, there will be cases in which it is preferable for the power ratio to be smaller than 1/3, and there will be cases in which settings of around 1/4 are more preferable. That is, the energy applied by the preliminary heating pulse signal (power×duration, unit: Joules) may be equal to the energy that is supplied by the trigger pulse signal, may be higher than the same, and may be lower than the same.

Figure 13:
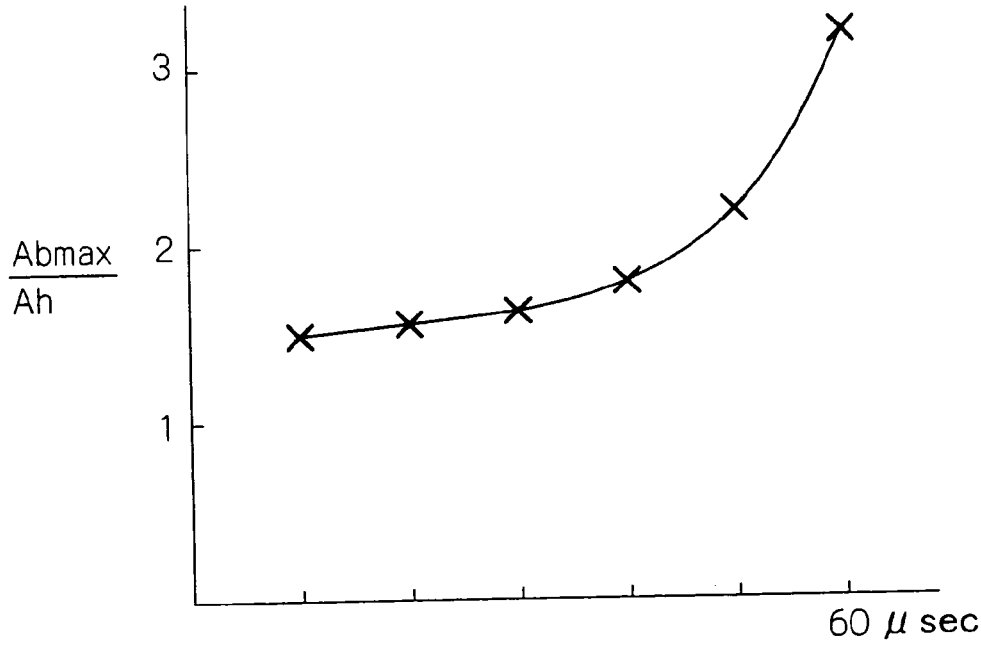
FIG. 13 is a characteristic showing size of a bubble that is generated by heating of the heater in accordance with changes in duration of the preliminary heating pulse signal.

FIG. 13 shows a relationship between the duration t1 of the preliminary heating pulse signal and the area ratio (maximum bubble area Abmax/heater area Ah). As can be seen from FIG. 13, the area ratio increases, which is to say the maximum bubble area increases, in accordance with increases in the duration t1 of the preliminary heating pulse signal. Here, it can be seen that the bubble area is around twice that in a case in which a single pulse signal is supplied.

However, when the duration t1 of the preliminary heating pulse signal was set to 70 μs or more, bubble generation started at around the time when application of the preliminary heating pulse signal was finishing, and significant growth of the bubble could not be obtained.

From the above, it can be seen that, in order to obtain large bubbles, it is preferable for the duration t1 of the preliminary heating pulse signal to be set to not less than around 10 times the duration t2 of the trigger pulse.

<Investigation 2>

Figure 14:
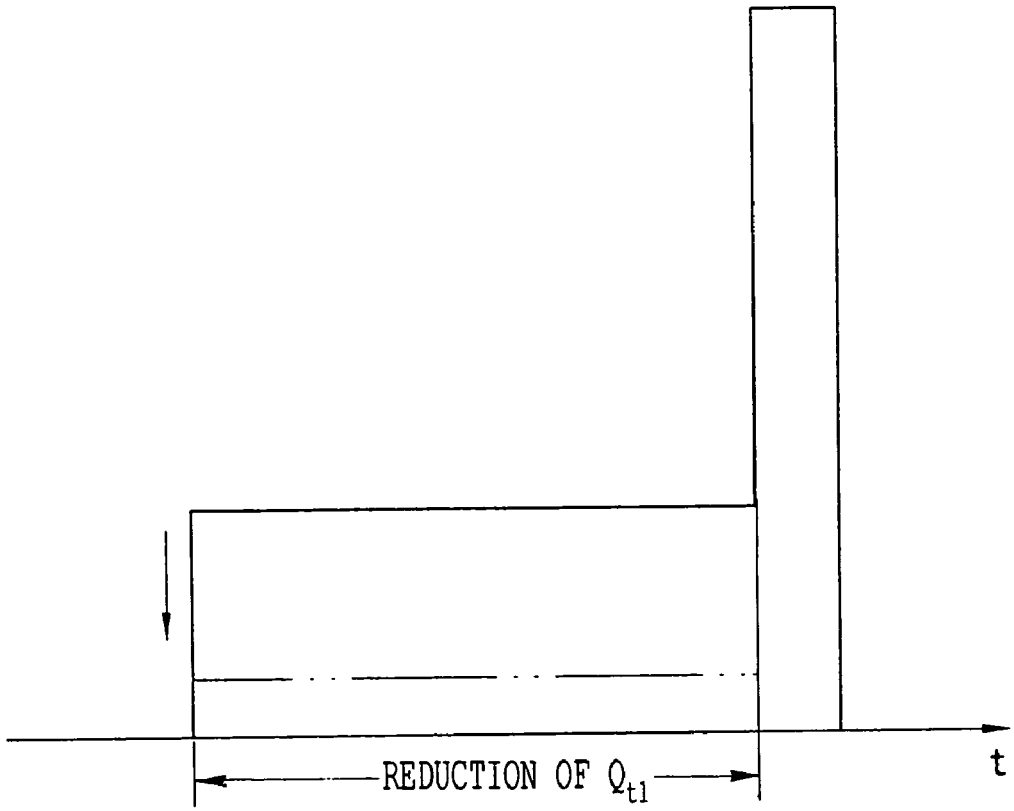
FIG. 14 is a waveform pattern view showing a relationship between the preliminary heating pulse signal and the trigger pulse signal.

In a second investigation, in cases in which, similarly to FIG. 12, the duration t1 of the preliminary heating pulse signal was varied and maximum bubble areas were measured, electrical power $Q_{t1}$ from the preliminary heating pulse signal was varied, as shown in FIG. 14, and maximum bubble areas were measured and studied. Here, the power $Q_{t1}$ corresponds to a value of voltage and a value of current supplied to the heater 34.

First, a case in which the power of the trigger pulse signal is set to 6.0 W and the power applied by the preliminary heating pulse signal is set to 0.25 W will be described. A power output ratio thereof is 1/24, and the power $Q_{t1}$ from the preliminary heating pulse signal has a ratio of 1/6 to the same power in the first investigation. These ratios are an example of settings relating to the values mentioned above, and are not limitations.

Because the power applied by the preliminary heating pulse signal is lowered, it is possible to increase the duration t1 of the preliminary heating pulse signal. Accordingly, the duration t1 of the preliminary heating pulse signal was measured for steps increasing by increments of 1000 μs from 1500 to 4500 μs.

Figure 15:
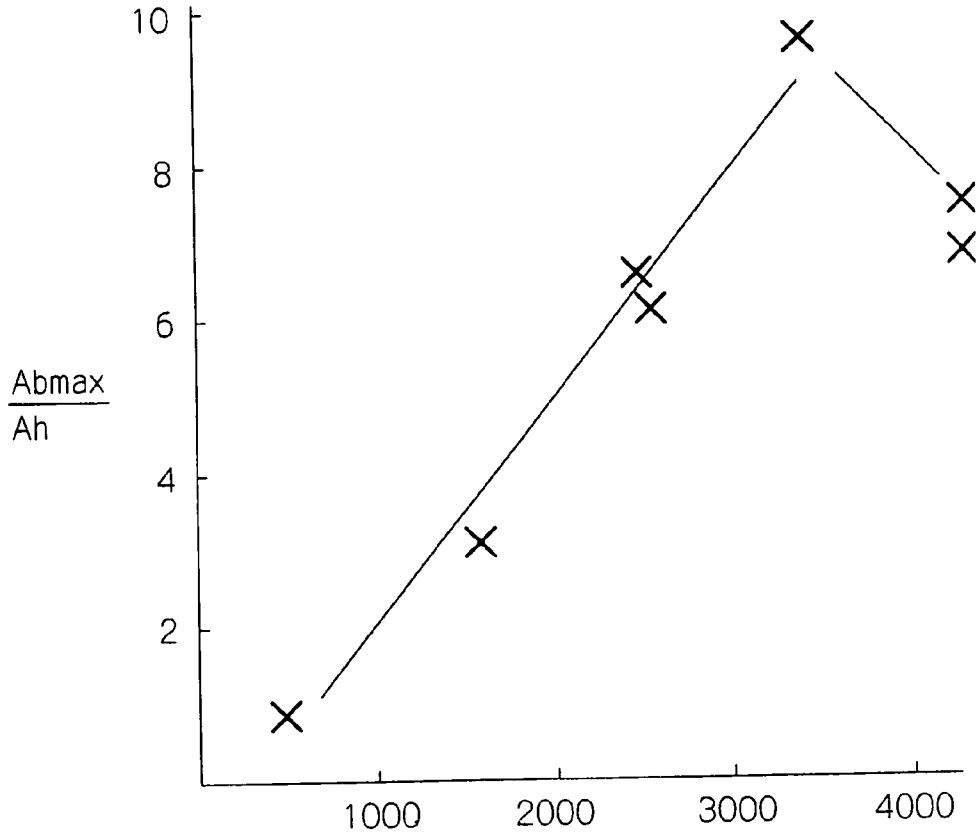
FIG. 15 is a characteristic showing size of a bubble that is generated by heating of the heater in accordance with changes in duration of the preliminary heating pulse signal.

FIG. 15 shows a relationship between the duration t1 of the preliminary heating pulse signal and the area ratio (Abmax/Ah) in the present investigation. As can be seen from FIG. 15, the area ratio increases greatly, which is to say the maximum bubble area increases greatly, in accordance with increases in the duration t1 of the preliminary heating pulse signal. Here, it can be seen that the bubble area is around six times (9/1.5) that in the case in which a single pulse signal was supplied. Hence, if bubble volume is taken as simply being a (3/2)th power of the area, the bubble volume can be provided with a volume of around fifteen times a bubble volume that is generated by a single pulse signal.

Figure 16:
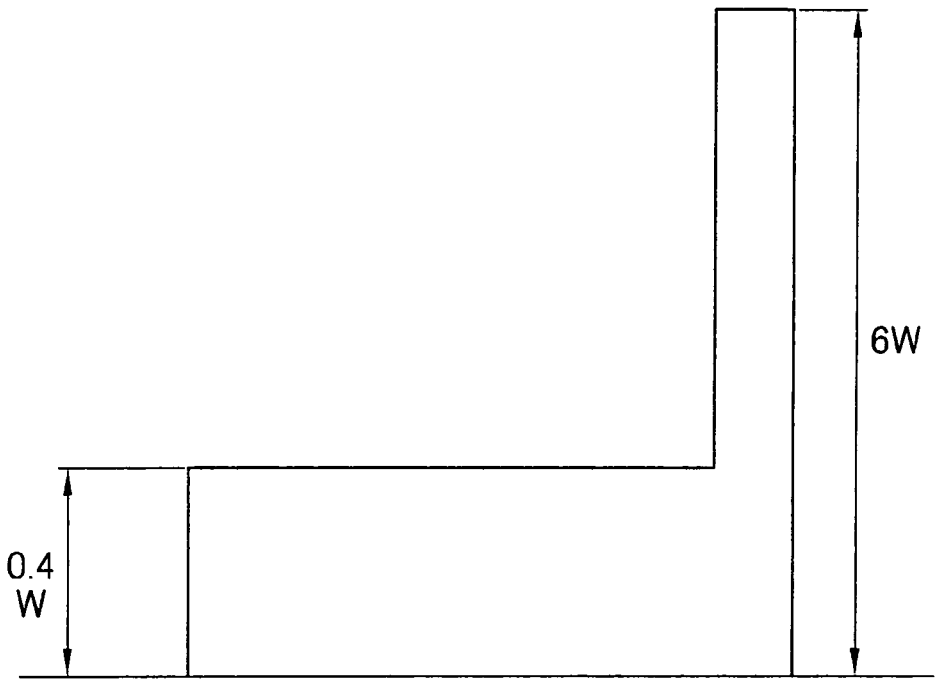
FIG. 16 is a waveform pattern view showing a relationship between the preliminary heating pulse signal and the trigger pulse signal.

Next, a case in which, as shown in FIG. 16, the power applied by the trigger pulse signal is set to 6.0 W and the power of the preliminary heating pulse signal is set to 0.4 W will be described. The power ratio here is 1/15, and the ratio of the power $Q_{t1}$ from the preliminary heating pulse signal to that in the first investigation is 1/3.75. These conditions are a case in which the power from the preliminary heating pulse signal is a little larger than in the conditions of FIG. 14 and smaller than the conditions of FIG. 12.

Here, the duration of the preliminary heating pulse signal was varied in two steps (500 μs and 1000 μs), and a bubble area after the commencement of bubble generation (i.e., in a state in which the bubble was growing) was measured for each duration t1.

Figure 17:
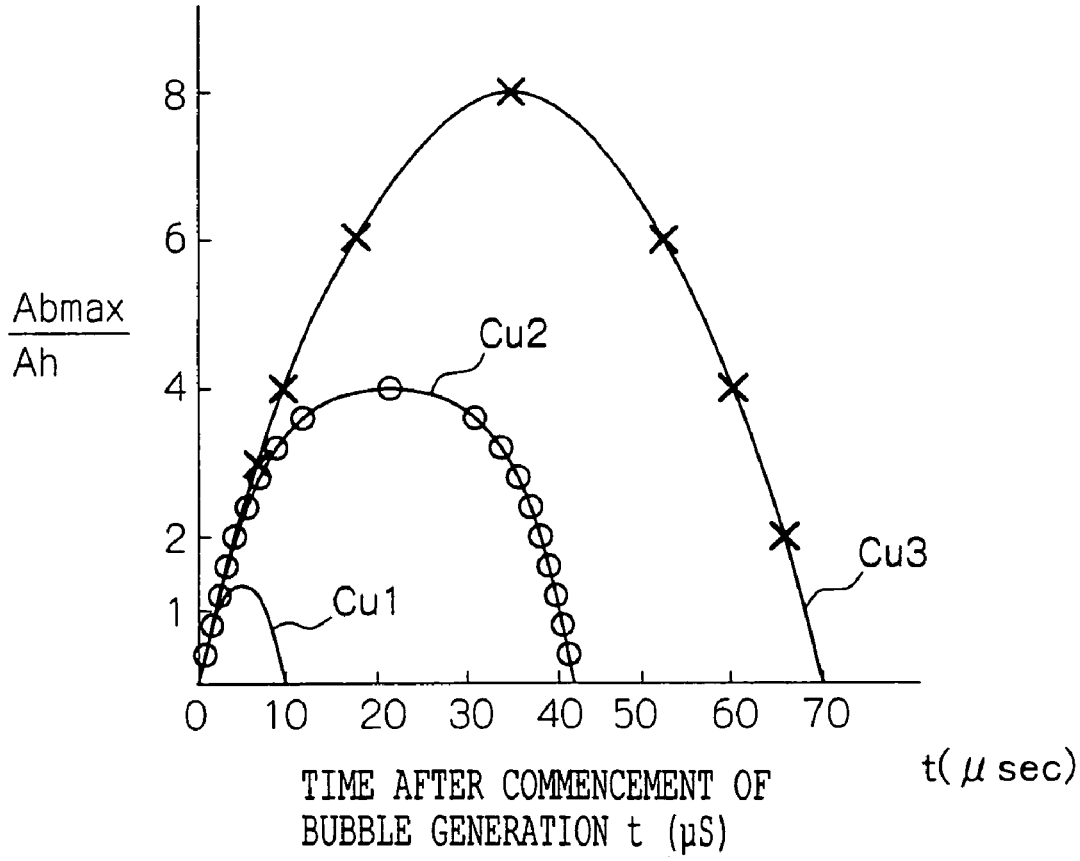
FIG. 17 is a characteristic showing relationships between time after a bubble is generated by heating of the heater and area of the bubble.

FIG. 17 shows a relationship between a time t after bubble generation commences and the area ratio (Abmax/Ah). In FIG. 17, a characteristic of bubble areas measured after bubble generation was commenced by a single pulse signal with a power of 2.5 W with which a preliminary heating pulse signal was not applied is shown as curve Cu1, a characteristic of bubble areas measured after bubble generation was commenced by a preliminary heating pulse signal of 500 μs is shown as curve Cu2, and a characteristic of bubble areas measured after bubble generation was commenced by a preliminary heating pulse signal of 1000 μs is shown as curve Cu3. 69

A gradient of each curve, that is, a rate of growth of the bubbles, can be seen to be approximately the same for each case. Accordingly, it can be seen that the growth rate of a bubble is sufficiently rapid even in a case in which a low-power, long-duration pulse signal is applied as pre-heating. That is, it can be seen that an impulse, which is pressure and time, is different in each condition. This can be explained by a boiling state having momentary explosive generation and growth, which in both cases is similarly based on spontaneous nucleation. In case of pre-heating, the period of bubble growth is much longer because the heat flux into liquid before boiling incipience is much larger and which obtained larger ejection power.

Further, according to the results described above, it is required: (1) that bubble generation does not occur during application of the preliminary heating pulse signal and that superheating goes beyond a saturation temperature (boiling point) of the operation fluid; and (2) that boiling by the trigger pulse generates numerous very small bubbles at the heater surface and that this is principally based on spontaneous nucleation. For such conditions, it is desirable if a rate of temperature rise is at least of the order of $1\times10^7$.

As described above, it is possible to generate large bubbles by changing pulse conditions relating to the driving signals applied to the heater 34. Thus, by applying this principle to the actuator 12 of the present embodiment, it is possible to provide a microactuator having a liquid driving force of a magnitude that cannot be obtained conventionally.

Figure 18:
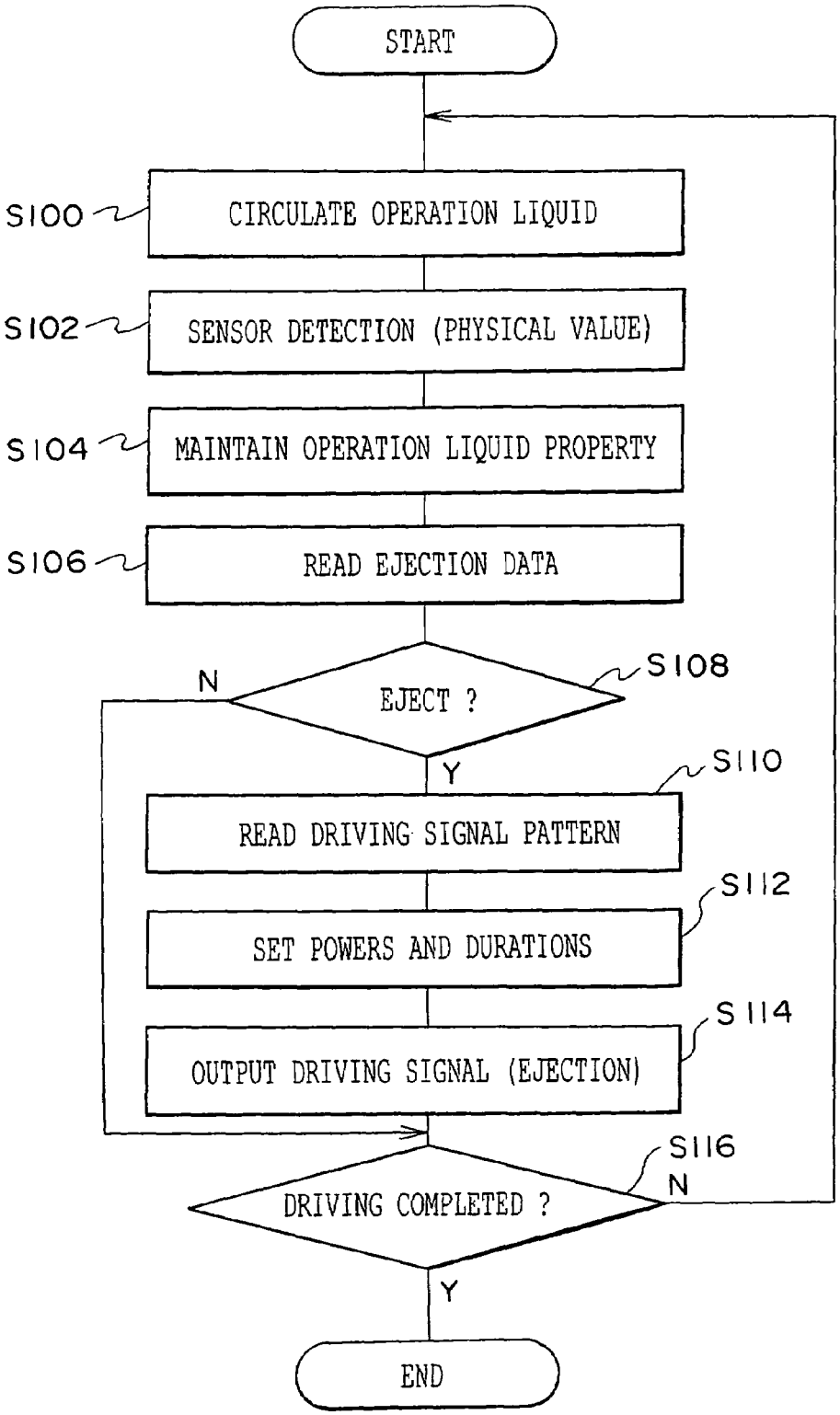
FIG. 18 is a flowchart showing flow of a process for driving the actuator relating to the present embodiment.

Next, operation of the droplet ejection device 10 of the present embodiment will be described with reference to the flowchart of FIG. 18.

The actuator 12 in the present embodiment is moved in one or more dimensions by an unillustrated transport system to a positional relationship relative to the medium 22, and the operation fluid is set to be ejectable. At this time, the processing routine of FIG. 18 is executed at the droplet ejection device 10. In step S100, circulation of the operation liquid 38 is commenced. This corresponds to the pump 14 being operated.

In step 102, a physical value of the operation liquid 38 is detected from output signals of the sensors 42. In a next step S104, control signals are outputted to the liquid regulation mechanism section 16 in order to keep properties constant. As a result, the operation liquid 38, which is circulated in the circulation piping 13 and liquid chamber 31 by the pump 14, is maintained with constant properties. This corresponds to the liquid regulation mechanism section 16 regulating composition of the operation liquid 38 in accordance with the signals from the sensor output detection section 18.

In step S106, ejection data, which represents whether or not one of the droplets 24 is to be ejected from the actuator 12, is read in. In a next step S108, it is judged whether or not to perform ejection. If ejection is be performed, the routine advances to step S110, and if ejection is not to be performed, the routine advances to step S116.

In step S110, a driving signal pattern according to the two-step pulse signal described above is read in. In a next step S112, electrical powers and durations are specified for this driving signal. That is, a power and duration t1 of a preliminary heating pulse signal and a power and duration t2 of a trigger pulse signal are set.

In step S114, the driving signal that has been specified in the above-described step S112 is outputted to the heater 34. The output of this driving signal corresponds to output of a driving signal by the driving section 20.

In step S116, it is judged whether or not driving of the actuator 12 has finished. If the judgment is negative, the routine returns to step S100 and the processing described above is repeated. If the judgement is positive, the present routine finishes.

Thus, according to the present embodiment, driving signals when droplets are to be ejected are constituted by preliminary heating pulse signals and trigger pulse signals, and the ejection of droplets by the generation of bubbles which are larger than a heat generation area of a heater is possible.

For the present embodiment, a case has been described in which a fixed trigger pulse signal is continuous with a fixed preliminary heating pulse signal to serve as the waveform pattern of a driving signal. However, the present invention is not limited thus. For example, the preliminary heating pulse signal and the trigger pulse signal may be separated, and one or both of the preliminary heating pulse signal and the trigger pulse signal may be varied.

Figure 19A:
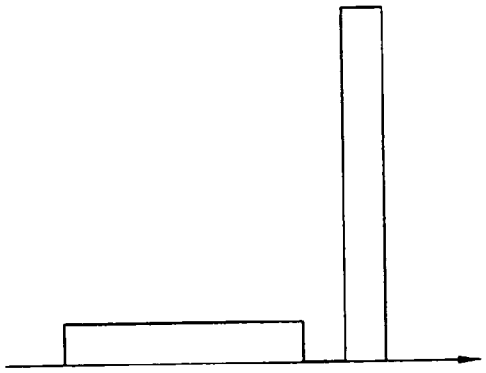
FIGS. 19A to 19E are graphs showing variant examples of waveform patterns for driving the actuator relating to the present embodiment.

FIGS. 19A to 19E show a number of variant examples of waveform patterns of driving signals. FIG. 19A shows an example of a case which includes a time gap separating the preliminary heating pulse signal and the trigger pulse signal. When the droplet ejection device 10 is applied in a practical system, current flow may be momentarily cut when the electrical power is switched or the like. Even in such a case, the effects of the present invention can be obtained by keeping this momentary off-time short.

Figure 19D:
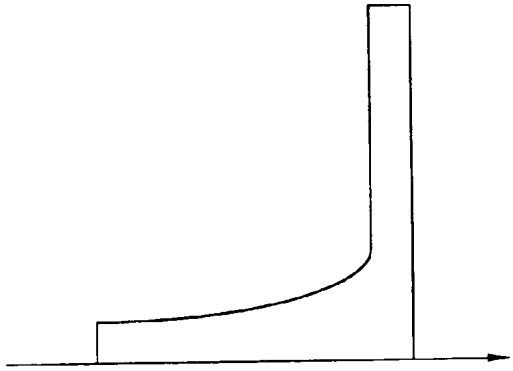
Figure 19B:
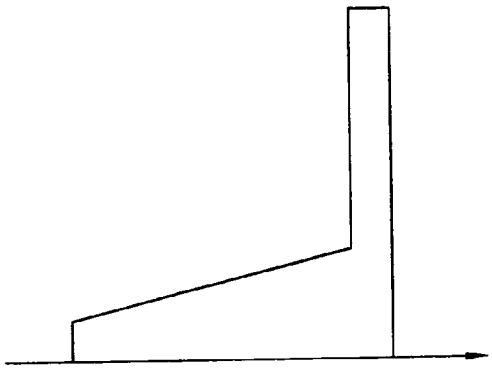

FIG. 19B shows a waveform pattern in which the power of the preliminary heating pulse signal is linearly increased. FIG. 19D shows a waveform pattern in which the power of the preliminary heating pulse signal is curvilinearly increased. In such cases, analog (or continuous) increases are allowable to a certain extent and, within ranges which do not adversely affect operation of the actuator 12, these cases are not problematic.

Figure 19E:
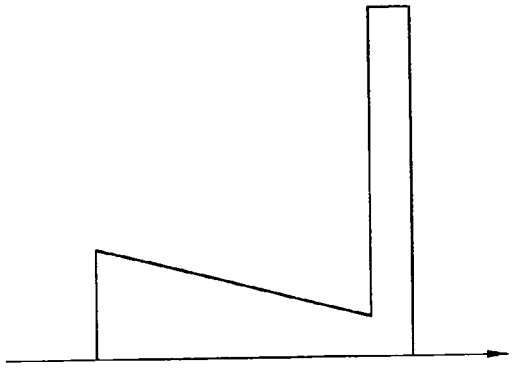
Figure 19C:
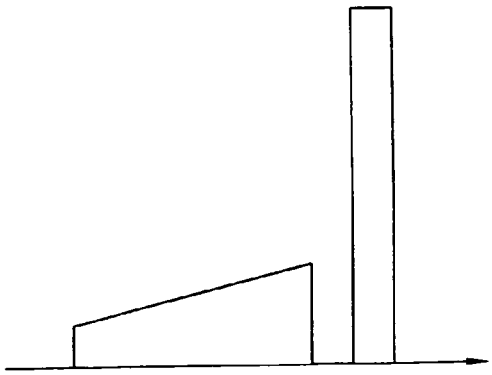

FIG. 19C shows a waveform pattern which includes a time gap separating the preliminary heating pulse signal and the trigger pulse signal, and in which the power of the preliminary heating pulse signal increases slightly.

Now, FIGS. 19A and 19C correspond to cases in which there is a momentary cut-off separating the preliminary heating pulse signal and the trigger pulse signal. However, because an objective of the preliminary heating pulse signal is, as mentioned above, to form a liquid layer on the heater in which the operation liquid 38 contains a substantial excess of heat energy, effective bubble generation can be obtained even with these waveform patterns.

FIG. 19E shows a waveform pattern in which a gradient of pre-heating power is opposite to that in FIG. 19B. That is, FIG. 19E illustrates a heating process in which the power is lower at a time of pre-heating completion than at a time of pre-heating commencement. This waveform is preferable in regard to shortening a duration of pre-heating. However, it is necessary to be cautious of excessive power, so as not to cause boiling at the start of pre-heating. This waveform can be selected as appropriate in system design.

According to the present invention as described above, because, in a step prior to applying ejection thermal energy for ejecting a droplet, preliminary heating is performed at a liquid interface region which contacts a heater, a bubble which is much larger than an area of the heater can be created for ejecting the droplet.

What is claimed is:

1. A droplet ejection device with high ejection capability, the device comprising:

(a) an actuator including a fluid chamber with an aperture for ejecting a droplet of an operation fluid accommodated in the fluid chamber, and a heater for providing thermal energy to the operation fluid for forming a bubble for droplet ejection; and (b) a controller which controls a driving signal to be inputted to the heater, (c) wherein the driving signal includes a preliminary heating pulse signal, which corresponds to a preliminary heating energy for preliminary heating of the operation fluid, and a trigger pulse signal, which corresponds to an ejection thermal energy for generation and growth of the bubble, a supply power of the preliminary heating pulse signal is smaller than a supply power of the trigger pulse signal, and a duration of heating by the preliminary heating pulse signal is longer than a duration of heating by the trigger pulse signal.

2. The device of claim 1, wherein the supply power of the preliminary heating pulse signal is at most around ¼ of the supply power of the trigger pulse signal.

3. The device of claim 1, wherein the duration of heating by the preliminary heating pulse signal is at least around 10 times the duration of heating by the trigger pulse signal.

4. The device of claim 1, wherein the preliminary heating energy is equal to or greater than the ejection thermal energy.

5. The device of claim 1, wherein the ejection thermal energy is equal to or greater than the preliminary heating energy.

6. The device of claim 1, wherein a rate of increase in temperature of the operation fluid during heating by the trigger pulse signal is at least $1\times10^7$ K/s.

7. The device of claim 1, wherein a magnitude of the preliminary heating energy is variable in accordance with a size of the bubble.

8. The device of claim 1, wherein the heater comprises a heat generation surface, and the fluid chamber includes a capacity not less than the volume of a sphere whose diameter is a diameter of the heat generation surface.

9. The device of claim 1, wherein the heater provides thermal energy to the operation fluid at least one of directly and via a heater protection layer.

10. The device of claim 1, further comprising a driving section which forms the driving signal and feeds the driving signal to the heater.

11. The device of claim 1, further comprising a sensor for detecting a physical characteristic of the operation fluid.

12. The device of claim 11, further comprising a sensor output detection section for detecting an output signal of a sensor.

13. The device of claim 1, further comprising a circulation section which causes the operation fluid to circulate in the actuator.

14. A method for ejecting a droplet by inputting a driving signal to a heater for providing thermal energy to an operation fluid and forming a bubble for droplet ejection, the method comprising:

inputting to a heater a preliminary heating pulse signal, which corresponds to a preliminary heating energy for preliminary heating of the operation fluid, with a predetermined supply power and a predetermined heating duration, for accumulating the preliminary heating energy in the operation fluid; and inputting to the heater a trigger pulse signal, which corresponds to an ejection thermal energy for generation and growth of the bubble, with a pre-established supply power and a pre-established heating duration, for providing the ejection thermal energy to the operation fluid and generating and growing the bubble, wherein the supply power of the preliminary heating pulse signal is smaller than the supply power of the trigger pulse signal, and the heating duration by the preliminary heating pulse signal is longer than the heating duration by the trigger pulse signal.

15. The method of claim 14, wherein the supply power of the preliminary heating pulse signal is at most around ¼ of the supply power of the trigger pulse signal.

16. The method of claim 14, wherein the heating duration by the preliminary heating pulse signal is at least around 10 times the heating duration by the trigger pulse signal.

17. The method of claim 14, wherein the preliminary heating energy is equal to or greater than the ejection thermal energy.

18. The method of claim 14, wherein the ejection thermal energy is equal to or greater than the preliminary heating energy.

19. The method of claim 14, wherein a rate of increase in temperature of the operation fluid during heating by the trigger pulse signal is at least $1\times10^7$ K/s.

20. The method of claim 14, wherein a magnitude of the preliminary heating energy is varied in accordance with a size of the bubble.

* * * * *